United States Patent [19]

Shionoya et al.

[11] Patent Number: 4,665,345

[45] Date of Patent: May 12, 1987

[54] PLASMA DISPLAY PANEL HAVING IMPROVED DISPLAY

[75] Inventors: Toshio Shionoya; Takashi Tsuboi, both of Kanagawa, Japan

[73] Assignee: Sony Corporation, Tokyo, Japan

[21] Appl. No.: 725,798

[22] Filed: Apr. 22, 1985

[30] Foreign Application Priority Data

Apr. 28, 1984 [JP] Japan ..... 59-87001

[51] Int. Cl.[4] ..... G09F 9/00

[52] U.S. Cl. ..... 315/169.4; 340/775; 340/805

[58] Field of Search ..... 315/169.4; 340/805, 340/789, 713, 775, 771, 811; 307/110

[56] References Cited

U.S. PATENT DOCUMENTS

| | | | |
|---|---|---|---|
| 3,777,182 | 12/1973 | Peters | 340/805 |
| 3,811,124 | 5/1974 | Kleen et al. | 340/805 |
| 3,976,912 | 8/1976 | Miavecz et al. | 340/805 |
| 4,349,819 | 9/1982 | Terakawa | 340/713 |
| 4,562,434 | 12/1985 | Amano | 315/169.4 |

*Primary Examiner*—Palmer C. DeMeo

*Attorney, Agent, or Firm*—Hill, Van Santen, Steadman & Simpson

[57] ABSTRACT

A plasma display panel having cathodes, anodes and trigger electrodes wherein the trigger electrodes correspond to a plurality of discharge electrodes which are sequentially scanned and wherein an insulating layer separates the trigger electrodes and the discharge electrodes and where a constant trigger voltage is supplied until the plurality of discharge electrodes corresponding to the trigger electrode have been activated. In the invention, the trigger voltage is quickly changed and is then returned to an intermediate level within the varied potential difference and the frequency of a trigger voltage pulse is reduced to one by the number of block discharged electrodes so that the power consumption of the trigger electrodes is greatly reduced and since the trigger voltage is returned to an intermediate level erroneous discharges will not be generated between inactive trigger electrodes and the other discharge electrodes to which data voltage pulses are supplied thus producing a high definition display.

12 Claims, 57 Drawing Figures

FIG. 2
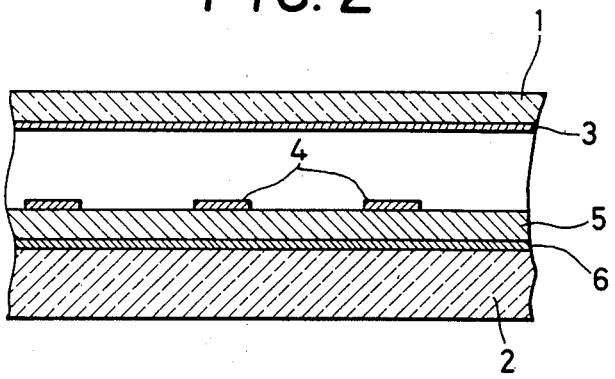
FIG. 3A
FIG. 3B
FIG. 3C
FIG. 3D
FIG. 3E
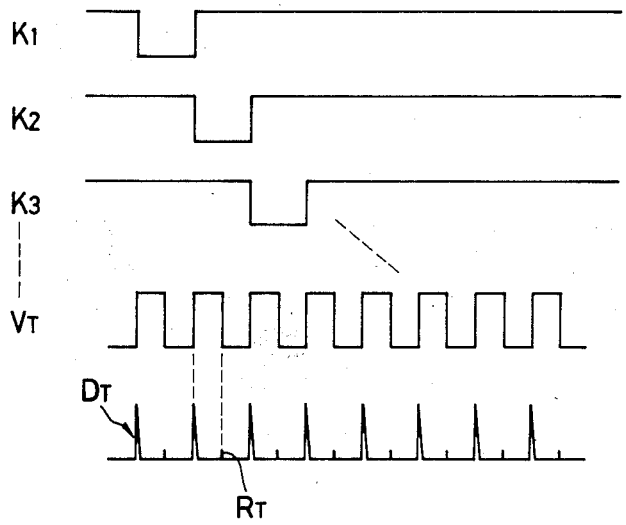

FIG. 4A VA
VA
VA−VB
VB
FIG. 4B VT
2VA
VA
VR
VAT
VE
TRIGGER INTERVAL
INACTIVE INTERVAL
PRE-CHARGE INTERVAL
VTK
FIG. 4C K1
VE
FIG. 4D K2
FIG. 4E K3
FIG. 4F Kn

DT
RT

VA
180V
VT
GROUND
VE
VUP
VA

FIG. 8A
FIG. 8B
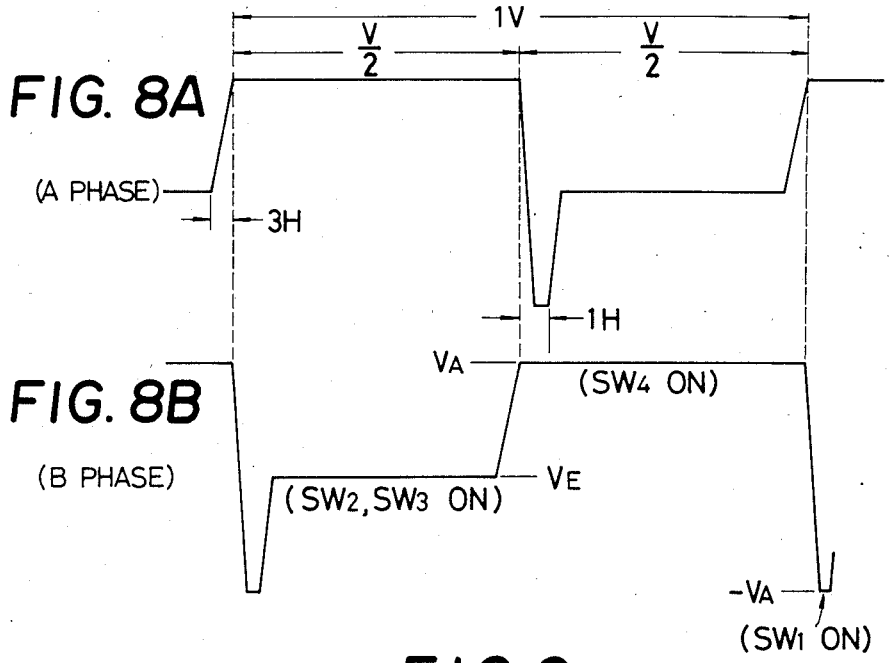
FIG. 9
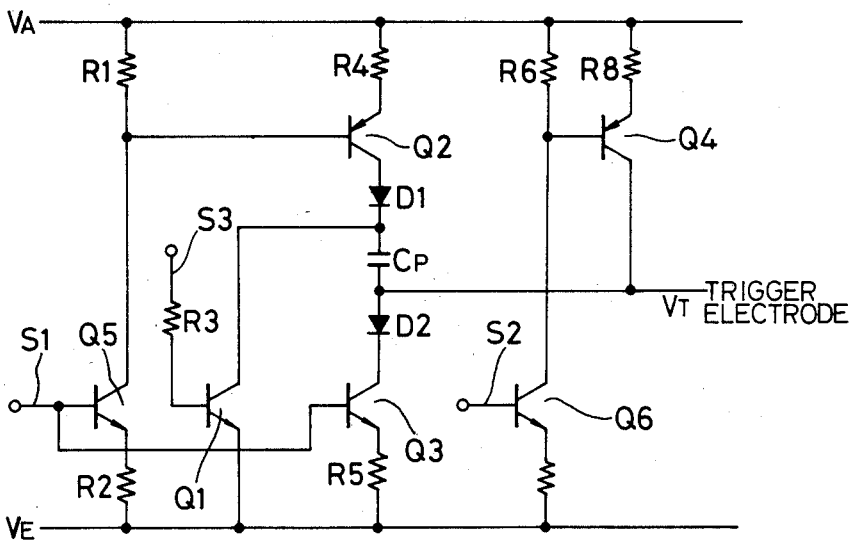

T1
T2
T3
T4
KM2
KM3
KA1
KA4
KA5
KA8

PLASMA DISPLAY PANEL HAVING IMPROVED DISPLAY

CROSS-REFERENCES TO RELATED CASES

This application is related to application entitled "A Sequential Selection Circuit" in which the inventor is Toshio Shionoya identified as U.S. Ser. No. 725,816, filed 4/22/85.

BACKGROUND OF THE INVENTION

1. Field of the Invention

This invention relates in general to a plasma display panel PDP and in particular to an improved trigger electrode circuit for producing an improved plasma display panel.

2. Description of the Prior Art

Plasma display panels of X-Y matrix type are known as a means for displaying characters or images. An X-electrode group which comprises a data electrode may comprise anodes to which high and low voltages are applied corresponding to the display data. A Y-electrode group which may be the scanning electrodes may comprise cathodes which are scanned in a line sequential manner and a negative voltage pulse is applied.

Japanese Patent disclosure number 56-128470 discloses a previously proposed plasma display panel having one or more trigger electrodes in addition to the X-Y electrodes. The trigger electrodes are arranged in the vicinity of the cathodes and are separated from them with an insulating layer. When a high voltage is applied to the trigger electrodes in synchronism with cathode scanning, a trigger discharge which is the inducing discharge is generated between the trigger electrodes and the cathodes. Such inducing discharge permits easy and rapid discharge between the anodes and cathodes so that a drive voltage can be decreased and variations among the discharge cells can be averaged and flickering can be reduced.

The trigger electrodes may be divided into a plurality of phases and the cathodes are divided into groups associated with each trigger electrode phase. When scanning drivers for the cathodes are commonly used among the phases and phase sequential scanning of the trigger electrodes is associated, the number of cathode scanning elements can be decreased to one/(number of phases). Such system is entitled "trigger matrix system" since third matrix electrodes are added to the system.

Such trigger matrix systems are subject to erroneous discharge due to the fact that differences in firing potential and maintaining discharge voltages among discharge cells which can be 10 volts or more can cause misfiring. Once erroneous discharge is generated in one cell it causes a trigger effect which causes sequential generation of erroneous discharges in non-selected cells of other phases. Also, there is a difference of about 10 volts between the discharge self-maintaining voltages at two ends of the panel due to the resistance of the cathode lines. For this reason, there is a margin of variation in the power supply voltage for preventing erroneous discharges which is as small as several volts and stable operation of the display panel over long period of time cannot be easily achieved.

Since potential of the trigger electrodes of the non-selected inactive phases falls to a low voltage such as ground potential an erroneous discharge may be generated between the surface of the trigger dielectric layer of a region of a non-selected phase and the anodes to which data voltages such as high voltage pulses are applied. Light emission due to the erroneous discharge is called "rain discharge" because it appears as a plurality of stripes along a number of anode lines in a vertical display direction. This causes considerable degradation in the display definition. Also, in such prior art display devices, the trigger system requires a large amount of power because the trigger electrodes are capacitive loads and are driven by a high voltage and high frequency pulse. In other words, assuming that there are four hundred cathodes and a frame frequency of 60 Hz a frequency of the cathode is about 24kHz which is about 40 microseconds/line. Since a high voltage pulse of about 300 volts having the same frequency as that of the cathode scanning must be applied to the trigger electrodes and since the trigger electrodes have capacitive loads as mentioned above the trigger circuit requires several tens of watts of power.

Since the trigger electrodes are mounted adjacent the cathode and with a very thin dielectric insulating layer separating them dielectric breakdown can easily occur.

SUMMARY OF THE INVENTION

The present invention solves the above problems and has an object to provide a plasma display panel in which power consumption of the trigger electrode driver circuit is decreased and erroneous discharge and dielectric breakdown is prevented so as to obtain high definition display and stable operation over long periods of time.

The plasma display panel according to the present invention comprises pairs of discharge electrodes arranged in a discharge space in an X-Y matrix form and with at least one trigger electrode for inducing discharge arranged adjacent one of said discharge electrodes and separated thereby with an insulating layer. The trigger electrode corresponds to a plurality of the discharge electrodes. The discharge electrodes corresponding to the trigger electrodes are activated in a line sequential manner and a constant trigger voltage is applied to the trigger electrodes so as to generate the inducing discharge between the trigger electrode and the corresponding discharge electrodes until the activation throughout the corresponding discharge electrodes has been completed. After the induced discharging the trigger voltage is abruptly changed and is thereafter returned to an intermediate level within the varied potential. With the arrangement of the invention, the power consumption is substantially decreased and high display definition and highly stable operation is obtained.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure.

BRIEF DESCRIPTION OF THE DRAWINGS

FIG. 2 is a partial sectional view of the display panel of FIG. 1;

FIGS. 3A through 3E are waveform charts for explaining the drive method of a conventional trigger electrode;

FIGS. 4A through 4G are waveform charts for explaining the drive method of a conventional trigger electrode;

FIG. 5 is a plot of the triggering voltage;

FIG. 8A and FIG. 8B illustrate output waveforms of the circuit shown in FIG. 7;

FIG. 9 is a detailed electrical schematic diagram of the circuit illustrated in FIG. 7;

DETAILED DESCRIPTION OF THE PREFERRED EMBODIMENTS

Figure 1:
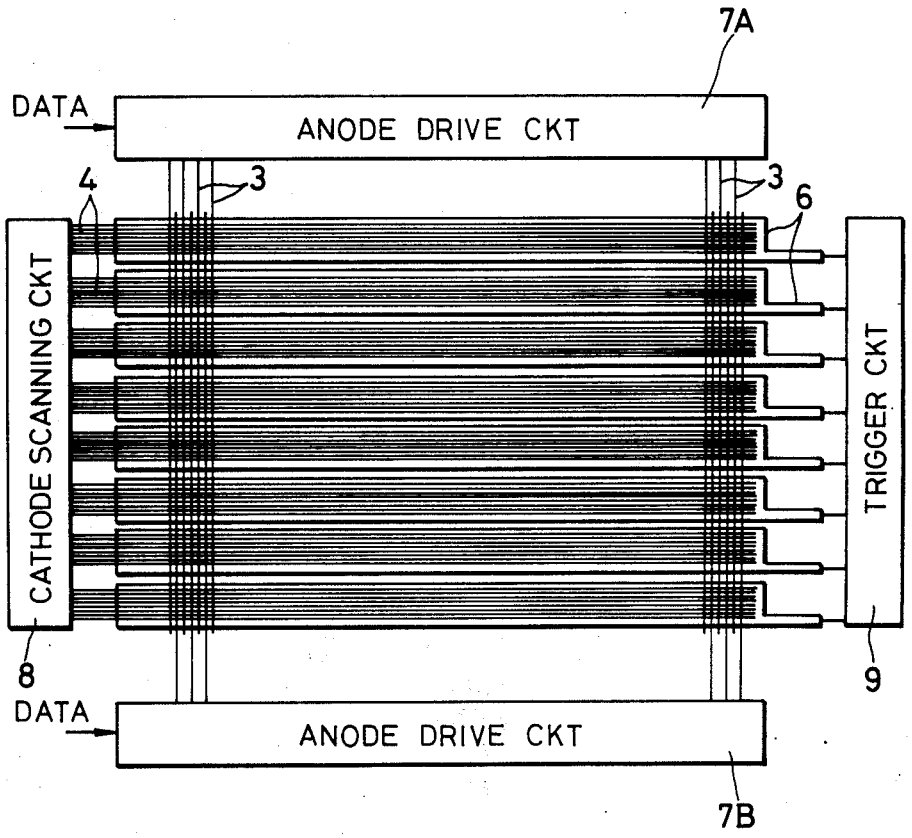
FIG. 1 is a schematic plan view of a plasma discharge panel to which the present invention is applied.

FIG. 1 is a schematic plan view of a plasma display panel PDP in which the present invention is incorporated and FIG. 2 is a partial sectional view of the plasma display panel. The plasma display panel includes a front glass panel 1, a rear glass panel 2 and anodes 3 which may be the data electrodes and cathodes 4 which may be the scanning electrodes. The anodes and cathodes are sandwiched between the glasses 1 and 2 with a suitable space and discharge gas therebetween and are arranged in an X-Y matrix form to oppose each other with small discharge gaps therebetween. Trigger electrodes 6 which are divided into a plurality of phases as, for example, eight phases in this particular example illustrated are arranged under and along parallel to the cathodes 4.

Alternate anodes 3 are connected to upper anode driver 7A and the other alternate anodes 3 are connected to a lower anode driver 7B. A high level state voltage as, for example "1" or a low level data voltage "0" corresponding to display data is supplied to the anodes in synchronism with cathode scanning with a shift register with parallel output and a switching output element of the driver 7A and 7B according to a display data input which is serial.

A negative voltage is supplied to the cathodes by a cathode scanning circuit 8 from the upper edge to a lower edge in a line sequential fashion. A discharge is generated between the selected cathode 4 and the anode 3 to which a high voltage is applied. The trigger electrode 6 are driven by a trigger circuit 9.

In a conventional trigger method illustrated in the waveform of FIGS. 3A through 3E a trigger voltage pulse $V_T$ illustrated in FIG. 3D of high level is supplied to one of the selected trigger electrodes 6 corresponding to an activated trigger phase in synchronism with the timing of cathode scanning pulses K1, K2, K3 . . . illustrated in FIGS. 3A, 3B and 3C. Trigger discharges which are inducing discharges are indicated by $D_T$ in FIG. 3E are generated between the trigger electrodes 6 and the opposing cathode 4. This causes a breakdown voltage between the cathode and anode to be decreased due to spatial ions caused by the trigger discharge so that the main discharge between the cathode and anode is induced.

However, this method of triggering requires a large amount of power and a bulky power supply.

When the trigger voltage $V_T$ illustrated in FIG. 3D falls, a small discharge $R_T$ illustrated in FIG. 3E is generated between the cathode or anode and a surface of the insulating layer or dielectric layer 5. The discharge $R_T$ serves to neutralize or discharge negative charges (electrons) which are on the surface of the insulating layer 5 by the trigger discharge $D_T$ which increases the potential of the surface of the layer 5 in the positive direction. Since the small discharge $R_T$ prepares the circuit for the generation of succeeding trigger discharges, it is designated herein as a recovery discharge.

It can be assumed that since the recovery discharge mainly serves to prepare the circuit for the generation of succeeding trigger discharges it need not be generated for each cathode line. In one activated phase of a trigger electrode covering several or several tens of cathode lines, the recovery discharge can be generated once in the trigger electrode after generating the trigger discharges corresponding to the number of cathodes. This is sufficient for the recovery function.

Figures 4G, 5:
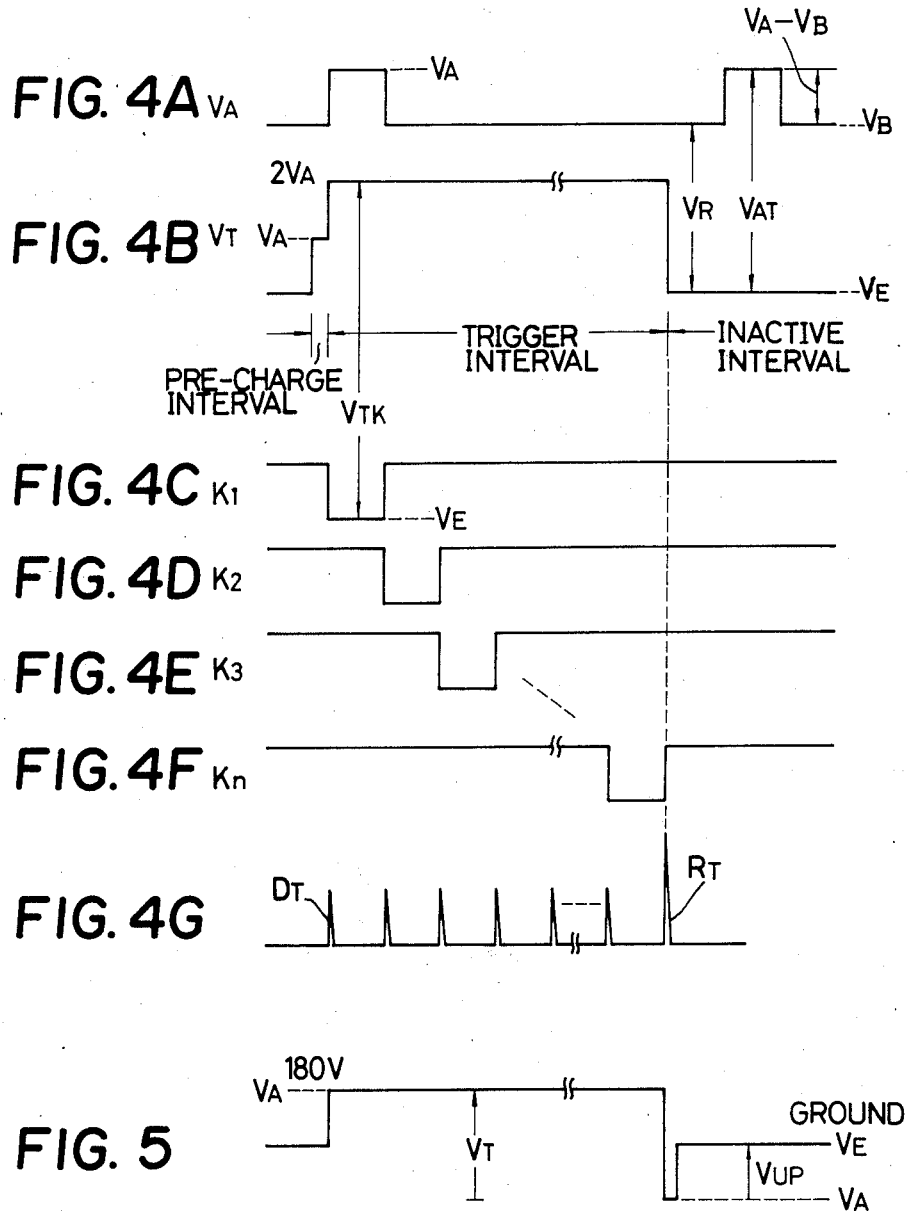

For this purpose, the trigger method illustrated in the waveform chart of FIGS. 4A through 4G is proposed. In FIG. 4B, $V_T$ is illustrated and when one trigger electrode 6 of one phase is provided for n cathodes 4, a constant trigger voltage $V_T$ equals $2V_A$ where $V_A$ is an anode drive voltage is applied to the trigger electrode 6 for a time until the sequential cathode scanning operations K1, K2 . . . Kn are completed. The trigger discharges illustrated in FIG. 4G are generated n times between the cathodes to which a negative cathode voltage $V_E$ is applied to the corresponding trigger electrode 6. This interval corresponds to a trigger interval for one trigger phase. When the scanning operations of the cathodes during this phase are completed, the trigger voltage is lowered to a low potential $V_E$ which is the inactive interval as shown in FIG. 4B and the trigger interval of the other phase is started. When the trigger voltage $V_T$ falls, a recovery discharge $R_T$ is generated for the overall region of the corresponding trigger phase so as to discharge or neutralize negative charges occurring in the surface of the insulating layer above the trigger electrode 6 so that this trigger phase will recover and be ready for the next trigger discharge.

During the triggering interval, when a positive data voltage pulse illustrated in FIG. 4A is applied to the anode 3, discharge emission is caused between the cathode of the triggered cell and the anode. It is to be noted that a precharge interval prior to the triggering interval in FIG. 4B is illustrated and is a charging interval of a precharge capacitor for producing the trigger voltage $V_T$ through a voltage doubler.

Using this method which is called a batched or block trigger the frequency of the trigger pulse is considerably decreased, and power consumption will be greatly reduced. For example, when the capacitance of one trigger electrode 6 is $C_T$ if the last or last four of the eight trigger electrodes 6 in FIG. 1 corresponds to one phase, the capacitance of each phase will be $4C_T$ and the trigger voltage will be 300 volts and a frame frequency is 60 Hz and the power consumption W for two phases for the trigger electrodes 6 is expressed by the following equation:

$$W=(\tfrac{1}{2})\cdot 4C_T V^2 T\times 60\ (\mathrm{Hz})\times 2\ (\mathrm{phases})$$

When $C_T$=5nF, W=0.1 watt. The power consumption of the batched triggering can be about 1/100 that of the power used for conventional triggering systems.

However, when the batched trigger method or a block trigger method is used since the voltage difference $V_{AT}$ illustrated in FIGS. 4A and 4B between the anode 3 to which the data voltage is applied in the trigger electrode 6 of low level $V_E$ becomes large during the inactive interval, erroneous discharge is undesirably generated. The erroneous discharge is rain discharge which appears as stripes along the anode lines thus considerably degrading the display definition.

During the triggering interval, a voltage difference $V_{TK}$ illustrated between FIGS. 4B and 4C between the trigger electrode 6 and the selected cathode 7 will be 300 volts or more and when this voltage is applied to the insulating layer 5 a dielectric breakdown occurs. It should be noted that $V_{TK}=V_T$ which is the trigger voltage minus $V_E$ which is the cathode voltage and $V_E$ is at a potential level of logic "L" or in other words at ground potential.

The present invention solves this problem and utilizes the trigger voltage having the waveform illustrated in FIG. 5. After the recovery discharge $R_T$ is generated at the trailing edge of the trigger voltage $V_T$, the potential of the trigger voltage $V_T$ is decreased to the intermediate potential level $V_E$. When the recovery discharge is generated positive charges are charged in the surface of the insulating layer 5. In this state, if the anode voltage rises an erroneous discharge is generated. However, since the trigger voltage $V_T$ is increased to the intermediate potential $V_E$ the erroneous discharge will be prevented.

The up magnitude $V_{UP}$ can be slightly larger than a pulse amplitude of $V_A$–$V_B$ of the anode voltage where $V_A$ is the anode drive voltage and $V_B$ is a bias voltage which is applied to the inactive anode 3 and is lower than $V_A$ by about 50 volts. When the trigger voltage falls and the recovery discharge $R_T$ has once been generated assuming that a voltage between the anode and trigger electrode in inactive state is $V_R$ as an illustrated in the waveform chart of FIG. 4A and FIG. 4B, unless a voltage greater than $V_R$ is applied to the trigger phase in the inactive interval erroneous discharges will never occur.

In practice as illustrated in FIG. 5, the voltage $V_A$ which is the same voltage as the anode drive voltage and might be 180 volts is applied to the trigger electrode 6 during the trigger interval of the active phase and after completing all of the trigger discharges between the trigger electrodes 6 and the cathodes 4 included in the active phase, the trigger voltage $V_T$ is instantaneously decreased to $-V_A$ so as to cause the generation of the recovery discharge $R_T$. Thereafter the trigger voltage is returned to the intermediate potential $V_E$ which is the ground potential. In this manner, a negative pulse is instantaneously applied so as to generate the recovery discharge at the end of the trigger interval. The method of the trigger voltage illustrated in FIG. 5 is called the refresh trigger method.

The surface of the insulating layer 5 is positively charged by the recovery discharge and the potential of the trigger electrode 6 of the inactive phase is stepped up during the following inactive interval. For this reason, a positive electric field is generated along the surface of the insulating layer 5. Such electric field which is formed in the inactive region prevents diffusion of plasma ions generated by the main discharge for displays occurring in the adjacent activated trigger electrode region of the active phase. For this reason, erroneous discharges at the inactive discharge cells which might be triggered by ion diffused in the inactive phase will be prevented.

Also, in the block trigger method illustrated in FIGS. 4A through 4G a voltage of $2V_A$ which may be 300 volts or more is applied during the trigger interval and thereafter dielectric breakdown can possibly occur. On the other hand, in the refresh trigger method illustrated in FIG. 5, since the trigger voltage $V_T$ varies with respect to the ON potential $V_E$ of the activated cathode by a maximum amount of plus or minus $V_A$, the maximum voltage will not be greater than 200 volts which is applied to the insulating layer 5. Thus, the insulating layer 5 will not have dielectric breakdown and such breakdown cannot occur which will prolong the life of the display panel. The insulating layer 5 can be thin because the application voltage is decreased and therefore the required trigger voltage can be decreased.

Figure 6:
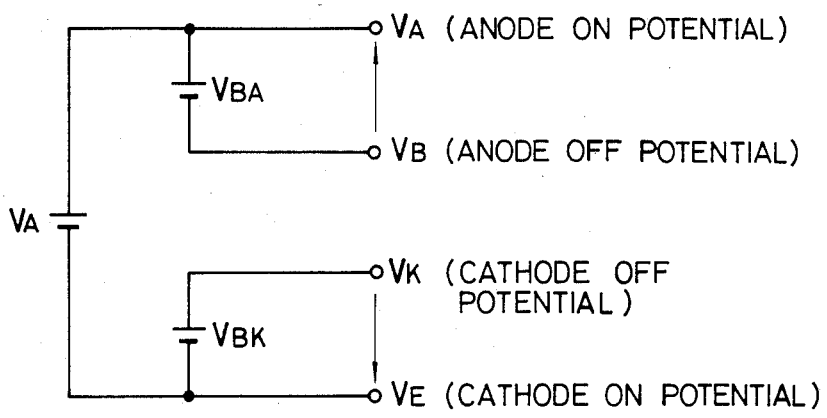
FIG. 6 is a diagram illustrating the potential relationship between the anodes and cathodes of a plasma display panel according to an embodiment of the present invention.

FIG. 6 is a schematic diagram of a power supply for the plasma display panel of this embodiment of this invention. An anode drive voltage $V_A$ which might be 150–180 volts is used as a main discharge voltage. With reference to the voltage source $V_A$ a negative bias voltage $V_{BA}$ of 50–90 volts is used and a bias potential $V_B$ in an anode off mode is derived from the negative side. Also, the negative side of the anode drive voltage source $V_A$ is provided with a reference voltage $V_E$ and in a cathode ON mode this potential is applied to the cathodes 4. The potential $V_E$ is at a logic level of "L" of the cathode scanning circuit 8 and can be, for example, at ground potential. Also, with reference to the potential $V_E$ a positive bias voltage source $V_{BK}$ is used and a cathode potential $V_K$ is derived from the positive side.

Figure 7:
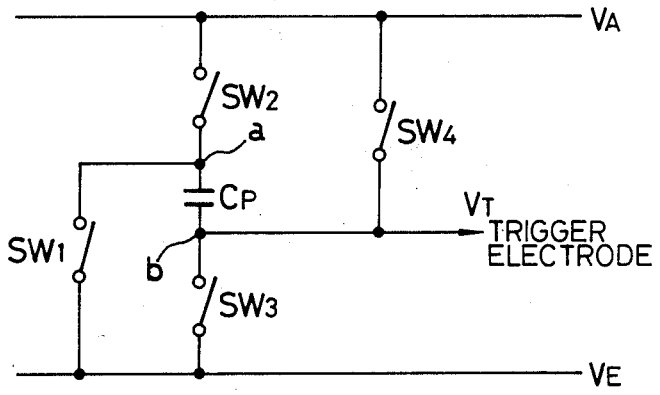
FIG. 7 is a diagram for explaining the principles of a trigger circuit of the present invention.

The trigger voltage $V_T$ is supplied to the trigger electrodes 6 and is produced by doubling the anode drive voltage $V_A$. FIG. 7 illustrates a principle trigger circuit and FIGS. 8A and 8B are waveform charts of the trigger voltage. In this embodiment the trigger circuits for the two phases are provided and the eight trigger electrodes 6 illustrated in FIG. 1 are divided into a pair of upper and lower phases with four in one phase. As shown in the trigger waveforms of FIGS. 8A and 8B, the trigger circuits are driven in a time divisional manner with every phase within a frame period of 1V which is the vertical interval.

As is illustrated in FIG. 7, the trigger circuit 9 two pairs of serial switches SW1 and SW2 along with SW3 and SW4 which are connected between a power supply line $V_A$ and a reference voltage line $V_E$. Connection points a and b of the respective series connected switches are coupled by a precharge capacitor $C_P$ and the output from connection point b between the switches SW3 and SW4 is supplied as the trigger to the trigger electrode 6.

Operation of the circuit of FIG. 7 occurs in the following manner. When the switches SW2 and SW3 are turned on with the other switches turned off, the capacitor $C_P$ is precharged to the voltage $V_A$. At this time, a potential at the connection point a of FIG. 7 is $V_A$ and the output level to the trigger electrodes 6 in B phase is $V_E$ as illustrated in FIG. 8B. This interval corresponds to the inactive interval. When the switches SW2 and SW3 are turned off, and the switch SW4 is turned on, the output will be $V_A$. This interval corresponds to the trigger interval of the B phase and in a region of the B phase, the trigger discharges are generated in a cathode sequence. In this trigger interval, charges accumulated in the capacitor $C_P$ will not vary and the potential at connection point a becomes $2V_A$. Then only the switch SW1 is turned on at the end of the trigger interval since the potential at the connection point a is supplied to $V_E$ an output level of the connection point b has a potential of $-V_A$ which is lower than $V_E$ by the voltage charged in the capacitor $C_P$. At this time, the recovery discharge due to the refresh trigger is generated between the surface of the insulating layer and the anode or cathode. Then the switches SW2 and SW3 are again turned on and the trigger potential returns to $V_E$. This operation is repeated for each frame cycle. A trigger waveform of the other phase A is reversd to that of phase B and is illustrated in FIG. 8A.

Using refresh timing even when the switch SW1 is turned on, since the other switches SW2 through SW4 are off so that the accumulated charges in the precharge capacitor $C_P$ will not be discharged. Therefore, the amount of power consumed by the precharge capacitor $C_P$ is very small. The capacitance of the capacitor $C_P$ is selected to be sufficiently larger than that of the trigger electrodes 6 thus enabling voltage doubling from $V_A$ to $-V_A$ without loss of power.

FIG. 9 is a detailed circuit diagram of a practical circuit embodiment corresponding to the circuit of FIG. 7. Transistors Q1, Q2, Q3 and Q4, respectively, correspond to the switches SW1, SW2, SW3 and SW4. The diodes D1 and D2 are inserted as protective diodes. Since the transistors Q2 and Q3 are turned on at the same time for precharging, an ON signal S1 to the transistor Q3 is supplied to the transistor Q2 through a level shift transistor Q5. During the trigger interval the transistor Q4 is turned on in response to a signal S2 supplied through a level shift transistor Q6 and the voltage $V_A$ is applied to the trigger electrodes 6. An ON signal S3 is supplied to the transistor Q1 at the end of the trigger interval and refresh triggering is performed at the trailing edge of the trigger voltage.

The desired and preferable voltage waveforms and the timing of the trigger voltage are described hereafter.

Figure 10A:
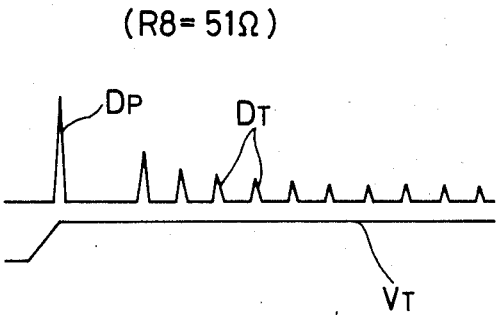
FIGS. 10A through 10C are voltage and discharge wave charts for illustrating the results when the rising speed of a trigger voltage is changed.
Figure 10B:
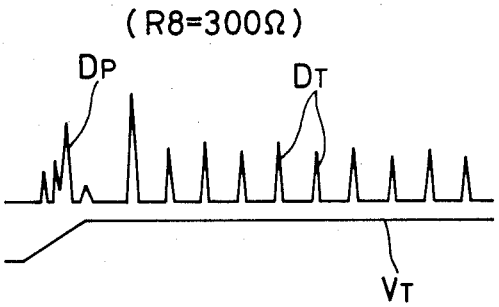
Figure 10C:
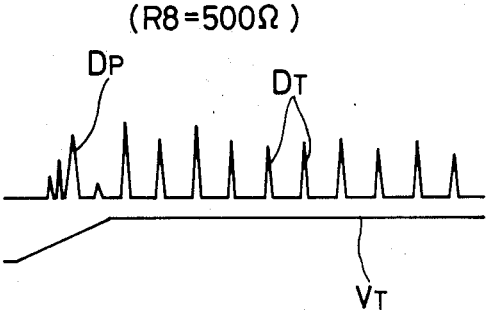

FIGS. 10A through 10C illustrate a voltage waveform $V_T$ and a trigger discharge $D_T$ and show different values for the resistor R8 illustrated in FIG. 9 which varies the rising speed of the trigger voltage at the initiation of triggering. FIG. 10A illustrates the case where the resistor R8 is equal to 51 ohms and the rise speed of the voltage $V_T$ is 170 volts/26 microseconds. FIG. 10B illustrates a rise speed of the voltage $V_T$ when the resistor R8 is 300 ohms and the rising speed of the voltage $V_T$ is 170 V/67 microseconds. FIG. 10C illustrates the case where the resistor R8 is 500 ohms and the rise time is 170 V/108 microseconds. In each case the trigger voltage $V_T$ is set at 300 $V_{P-P}$, the anode bias voltage $V_{BA}$ is set at 50 volts and the cathode bias voltage $V_{BK}$ is set at 45 volts. As is illustrated in the waveforms of FIGS. 10A through 10C when the rise speed of the trigger voltage is lowered the stronger trigger discharge $D_T$ will be obtained. When the rise speed is high or steep, the leading discharge $D_P$ will be large and will be generated between the trigger electrode and the cathode or anode and the positive charges accumulated in the insulating layer 5 are discharged. Thus, this makes the generation of the following trigger discharge difficult.

The trigger voltage for the selected active phase must rise before starting the cathode selection or scanning. Thus, the trigger voltage presumably reaches a high level within about 2H where H is about 40 microseconds in terms of a scanning interval of the cathode line so as to start rising from about 3H before every phase switching time. The rise time can be adjusted by the resistance of the emitter electrode R8 of the transistor Q4 shown in FIG. 9.

Figure 11A:
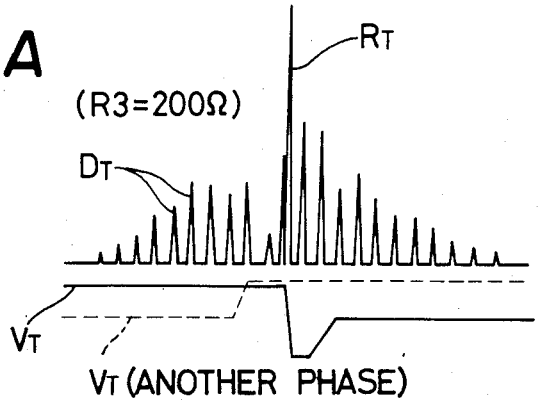
FIGS. 11A through 11C illustrate voltage and discharge wave form charts when the falling speed of the trigger voltage is changed.
Figure 11B:
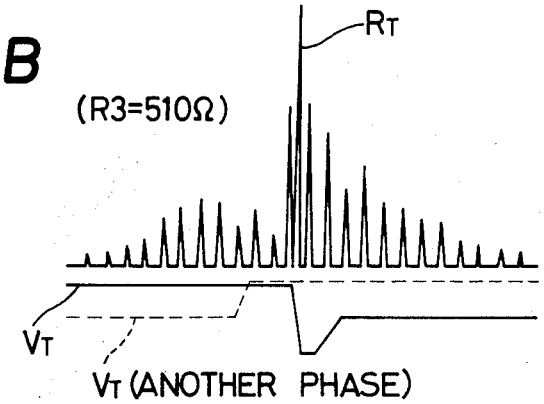
Figure 11C:
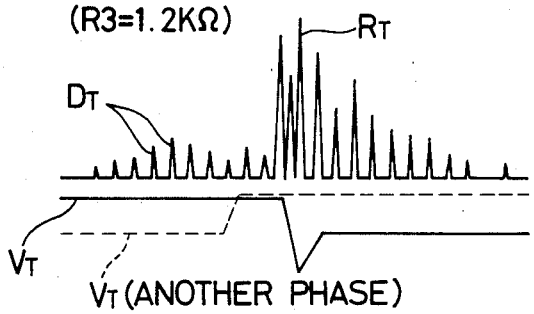

FIGS. 11A through 11C illustrate the voltage waveform $V_T$ and the recovery charge $R_T$ when the falling speed of the trigger voltage $V_T$ varies. The falling speed of $V_T$ can be adjusted by the resistance of the base resistor R3 of the transistor Q1 illustrated in FIG. 9. The resistance of the resistor R3 is increased as shown in FIGS. 11A through 11C thereby decreasing the rising speed. With the resistance of resistor R3 being 200 ohms in FIG. 11A, 510 ohms in FIG. 11B and 1.2 k ohms in FIG. 11C. This increase in the resistance of R3 decreases the rise speed. In this case, the trigger voltage is 320 $V_{P-P}$ and the anode and cathode bias voltages $V_{BA}$ and $V_{BK}$ are the same as those illustrated in FIGS. 10A through 10C. As is apparent from these waveform charts the higher the falling speed of the refresh trigger, the stronger the strength of the recovery discharge $R_T$ becomes. Thus, when the recovery discharge $R_T$ is strongest, the trigger discharges $D_T$ can be completely performed during the next trigger interval after the next inactive interval. This is because the negative charges occurring on the insulating layer 5 by the trigger discharges are neutralized and discharged by the strong recovery discharge due to refreshing so as to increase the surface potential of the insulating layer and the next trigger discharge can therefore be easily generated.

Figure 12A:
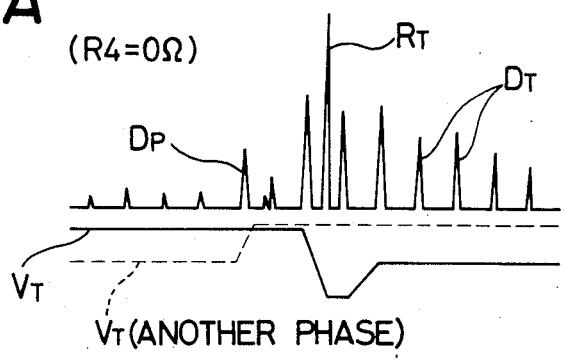
FIGS. 12A through 12C illustrate voltage and discharge waveform charts when the intermediate level return speed of the trigger voltage is changed.
Figure 12B:
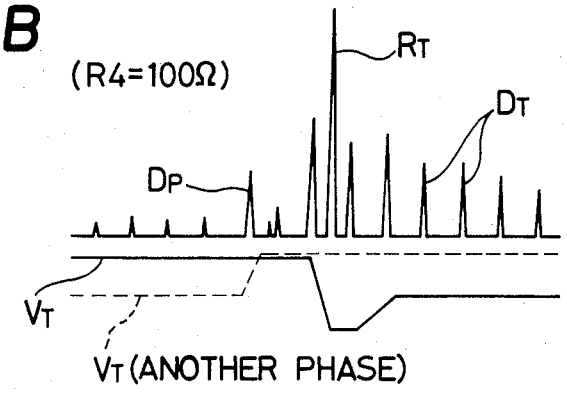
Figure 12C:
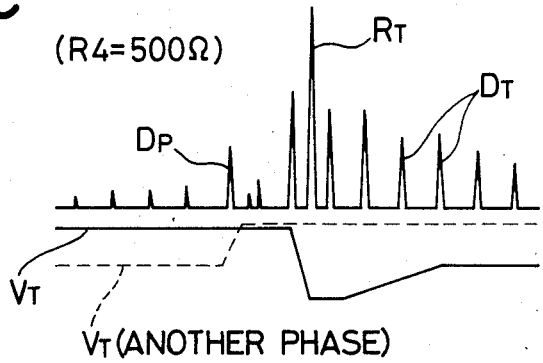

FIGS. 12A through 12C illustrate the voltage waveform and the trigger discharge when the return speed for returning the trigger voltage $V_T$ to the intermediate potential $V_E$ is varied. The return speed of the trigger voltage can be varied by changing the resistance of the emitter resistor R4 of the transistor Q2 shown in FIG. 9. The resistance of the resistor R4 in FIG. 12A is equal to 0 ohms, the resistance in FIG. 12B is 100 ohms and the resistance in FIG. 12C is 500 ohms. As the resistance of the resistor R4 increases as illustrated in FIGS. 12A through 12C the return speed of $V_T$ will be decreased. In FIGS. 12A through 12C the trigger voltage is 300 volts $V_{P-P}$ and the anode and cathode. bias voltages are the same as those used in FIGS. 10A through 10C and 11A and 11C.

As can be seen from the waveform chart shown in FIGS. 12A through 12C the return speed does not influence the trigger discharge $V_T$ or recovery discharge $R_T$. However, when the return timing of the trigger voltage $V_T$ to the intermediate potential $V_E$ is delayed, the previously mentioned rain discharge can be undesirably generated between the trigger electrode 6 and anodes 3 to which the data voltage is applied. Therefore, the return speed is preferably maintained as high as possible.

Figure 13A:
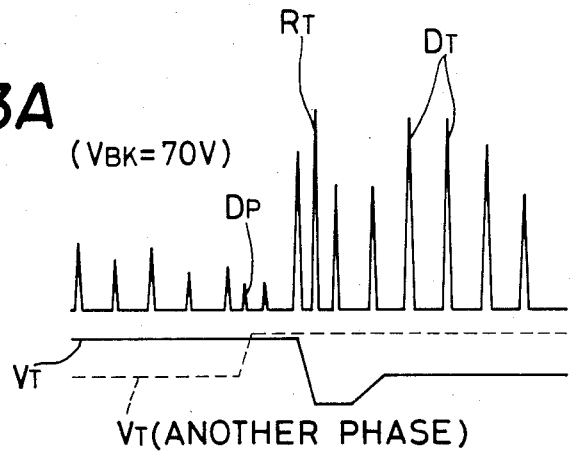
FIGS. 13A through 13C illustrate trigger voltage and discharge waveforms when a cathode bias voltage is changed.
Figure 13B:
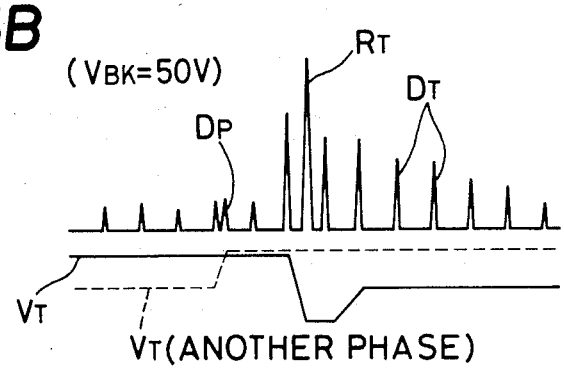
Figure 13C:
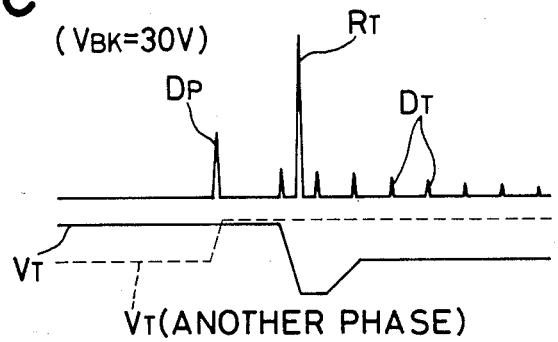

FIGS. 13A through 13C illustrate the waveform chart for the trigger discharge when the cathode bias voltage $V_{BK}$ illustrated in FIG. 6 is varied. Under these conditions the rise speed of the trigger voltage $V_T$ is kept constant. The trigger voltage is 310 $V_{P-P}$ and the anode bias voltage $VB_{BA}$ is fixed at 90 volts. The cathode bias voltage $V_{BK}$ illustrated in FIGS. 13A through 13C are lowered as, for example, 70 volts in FIG. 13A, 50 volts in FIG. 13B and 30 volts in FIG. 13C. It is apparent from FIGS. 13A through 13C that the higher the cathode bias voltage is the stronger the trigger discharge $D_T$ becomes. This is because the amplitude of the drive voltage applied to the cathodes 4 is large and the lead discharge $D_P$ at the initiation of the trigger interval of the active phase is small. Also, as shown in FIGS. 13A through 13C when the cathode bias voltage $V_{BK}$ becomes lower the lead discharge emission becomes large. Since the lead discharge discharges the positive charges accumulated on the surface of the insulating layer 5 in the region of the activated trigger phase, the voltage $V_{BK}$ is preferably set to be high and the leading discharge is preferably set to be small.

Figure 14A:
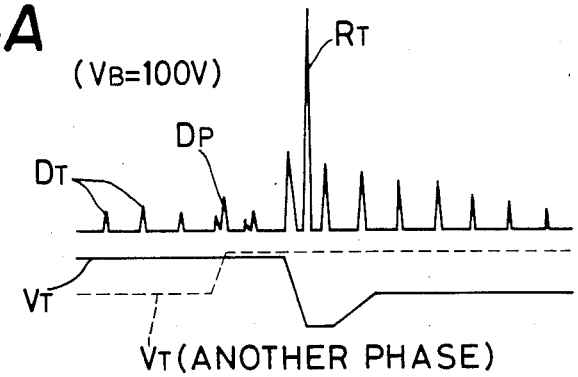
FIGS. 14A through 14C illustrate trigger voltage and discharge waveform when an anode bias voltage is changed.
Figure 14B:
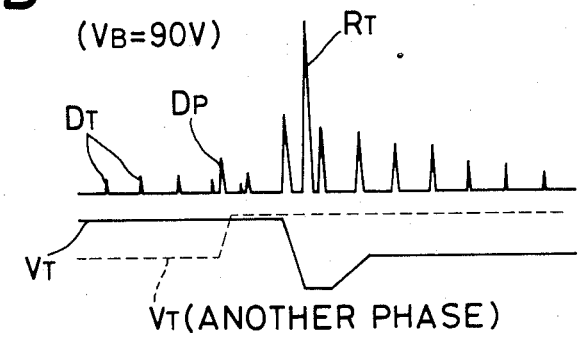
Figure 14C:
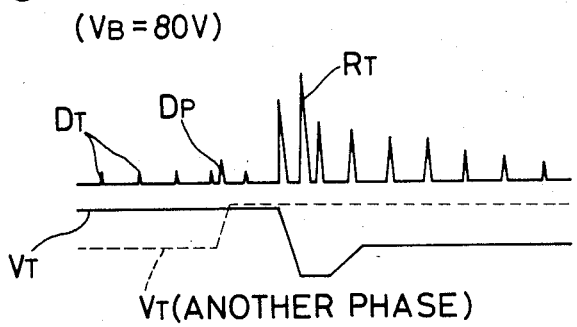

FIGS. 14A through 14C illustrate the waveform charts of the trigger discharge when the anode bias voltage $V_{BA}$ in FIG. 6 varies as, for example, in FIG. 14A it is 100 volts, in FIG. 14B it is 90 volts and in FIG. 14C it is 80 volts. In this case, the falling speed of the trigger voltage $V_T$ is kept constant. The trigger voltage is set at 310 $V_{P-P}'$ and the cathode bias voltage $V_{BK}$ is fixed at 45 volts. The anode off potential $V_B$ with respect to the reference potential $V_E$ are 100 volts, 90 volts and 80 volts in FIGS. 14A, 14B and 14C respectively, and as can be seen the recovery discharge $R_T$ becomes stronger when the anode off volt is $V_B$ is higher. This is the reason that the recovery discharge is mainl generated between the surface of the insulating layer 5 and the anodes 3. Therefore, when the anode off potential $V_B$ increases as to enlarge the difference between the potential $V_B$ and the peak voltage $-V_A$ the refresh pulse becomes large, the stronger recovery discharge can be generated. As illustrated in FIG. 14A, the next trigger discharge can be assured.

It should be noted that an increase in the anode off potential $V_B$ corresponds to a decrease in the anode bias voltage $V_{BA}$ illustrated in FIG. 6. Therefore, when the potential $V_B$ is higher, the anode driver element having a lower breakdown voltage can be employed.

Figure 15:
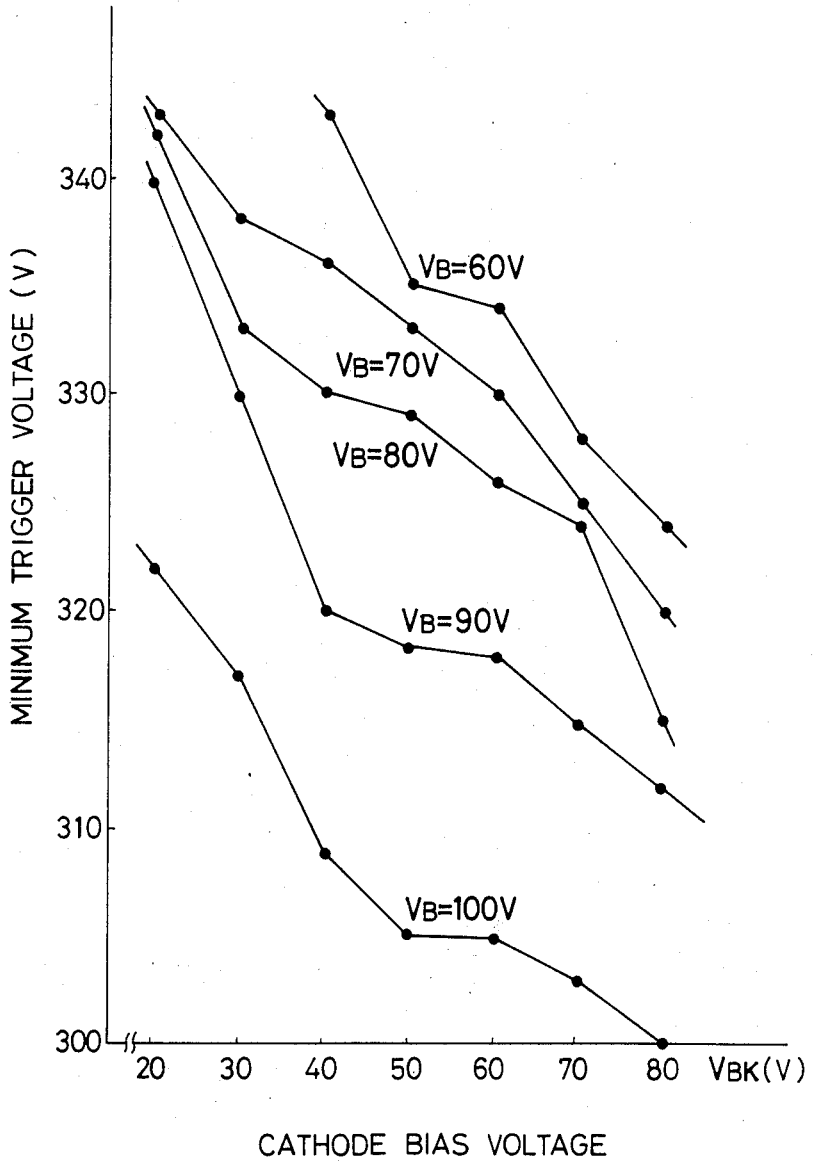
FIG. 15 is a graph showing the relationship between the cathode and anode bias voltages and the lowest trigger voltage.

FIG. 15 is a graph showing the relationship between the necessary minimum value (P—P value) of the trigger voltage $V_T$ and the anode and cathode bias voltages. As is illustrated in FIG. 15, the higher the cathode bias voltage $V_{BK}$ and the anode off voltage $V_B$ are the lower will be the minimum trigger voltage. The cause of a decrease in the trigger voltage is that when the cathode bias voltage is increased, the leading discharge is suppressed so that the positive charges cannot be discharged from the insulating layer surface and a potential difference between the cathodes enabled by the sequence scanning and the insulating layer surface becomes large. Also, when the anode bias voltage is increased, the stronger recovery discharge is generated and the potential of the insulating layer becomes higher thereby allowing the easy generation of the next trigger discharge.

As described above, the rising time of the beginning of the trigger interval is set to be lower and the falling time at the end thereof is set to be higher. Furthermore, the cathode and anode biases are set to be higher thus providing satisfactory operation.

As shown in FIG. 8A in the trigger drive waveform of this embodiment, the rise and fall times are respectively set to be about 3H where H is about 40 microseconds and about 1H.

Figure 16:
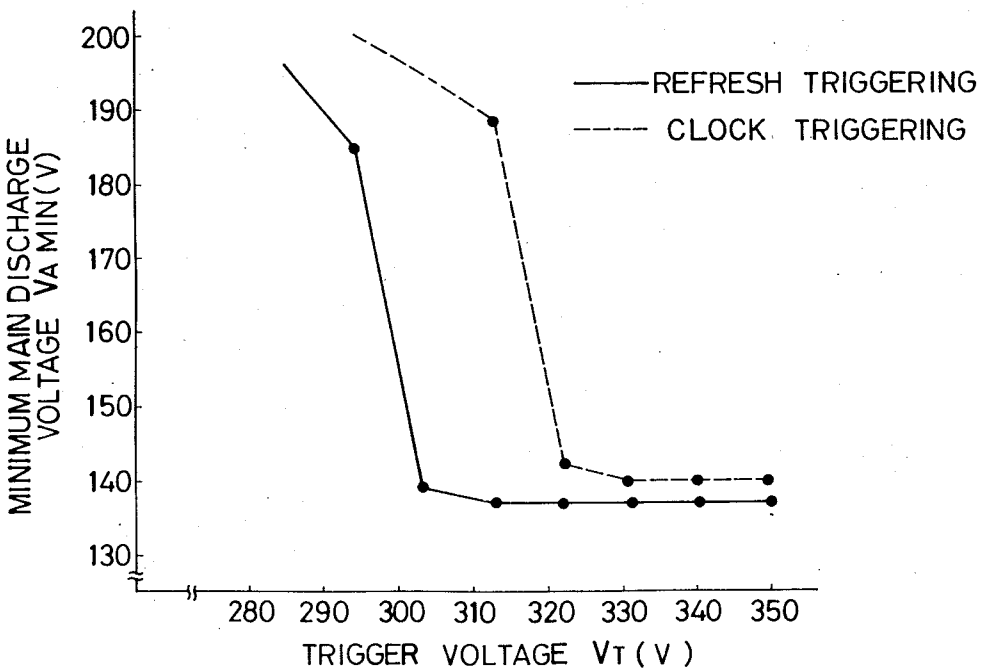
FIG. 16 is a graph showing the relationship between the trigger voltage and the minimum main discharge voltage.

FIG. 16 is a graph in which the block trigger method is represented by the trigger waveform $V_T$ illustrated in FIGS. 4A through 4G and is compared with the refresh trigger method represented by the trigger waveforms $V_T$ illustrated in FIG. 5. The trigger voltage $V_T$ is plotted against the abscissa and the minimum main discharge voltage $V_A$ which is the anode drive voltage without erroneous discharge is plotted along the ordinate. As described previously, the trigger method proposed by the present application has the main advantages of decreasing the main discharge voltage by the trigger discharge. However, when the trigger voltage $V_T$ is gradually lowered as shown in FIG. 16, the trigger discharge will not be generated below a given level and the main discharge voltage required abruptly increases.

In terms of a voltage region of $V_T$ in which the trigger effect is available as for the block batch trigger method it can be obtained when the trigger voltage $V_T$ is 320 volts or higher as indicated by the dotted line. However, in the refresh trigger method the trigger effect can be obtained when the slightly lower trigger voltage of 300 volts or higher is applied as indicated by solid line. The minimum main discharge voltage $V_A$ under the condition that the trigger discharge is effective is 140 volts or higher in the block trigger method. In the refresh trigger method when the voltage $V_A$ is at a 138 volts or higher, a stable discharge display can be provided.

An example in which the refresh trigger method is applied to a trigger matrix drive which is a method for commonly using a cathode drive means among a plurality of trigger phases will next be described. As described above, in the refresh trigger method the trigger electrode 6 in the active phase generates the leading discharge $D_P$ and the recovery discharge $R_T$ respectively at the first and at the end of the trigger interval and these discharges are generated in the entire trigger region in the selected phase. Additionally, the discharge timings of these leading discharge and recovery discharges are involved in the active interval of trigger electrodes in the adjacent phase. Therefore, in the trigger matrix in which the cathode driver is commonly used among a plurality of trigger phases so as to reduce the number of drive elements commonly driven cathode lines in different phases are activated at boundary portions of the inactive trigger regions adjoining an active phase which results in the generation of erroneous discharges.

Figure 17:
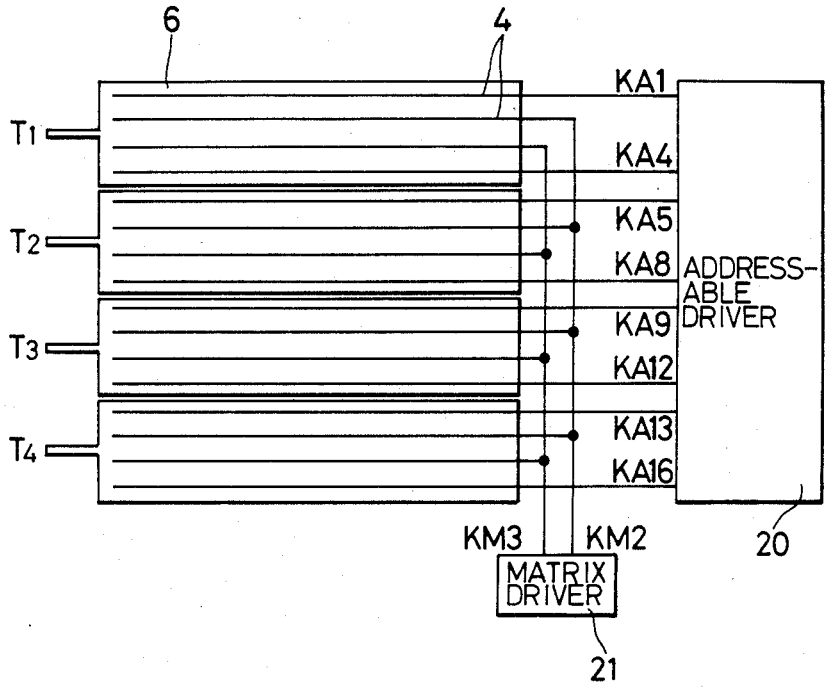
FIG. 17 is a drive circuit diagram illustrating the embodiment of the trigger matrix system.
Figures 18A, 18B, 18C, 18D, 18E, 18F, 18G, 18H, 18I, 18J:
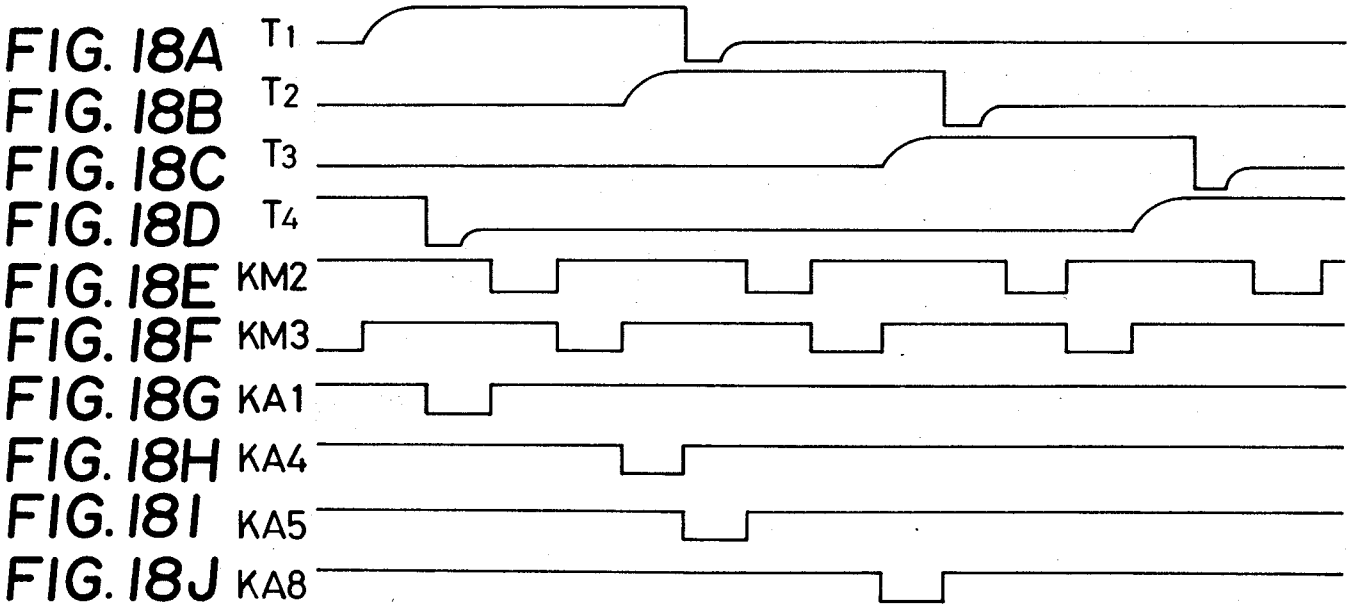
FIGS. 18A through 18J is an operational waveform chart for the circuit of FIG. 17.

FIG. 17 illustrates a trigger matrix drive circuit which can solve this problem. The circuit comprises four phase triggers T1 through T4 each having four cathodes. The trigger electrodes 6 of each phase are driven in a phase sequential manner as indicated by T1 through T4 in FIGS. 18A through 18D. The cathodes 4 located at boundary portions of the trigger electrode 6 are not commonly driven together with those in the adjacent phases and are independently and selectively driven by an addressable driver 20 at a predetermined timing as indicated by the waveforms KA1, KA4, KA5 and KA8 illustrated respectively in FIGS. 18G through 18J. In the middle portion of each trigger phase since these cathodes are not selected in an overlapping manner by sequential triggering, the cathode lines are commonly connected among four phases and as indicated by the waveforms KM2 and KM3 of FIGS. 18E and 18F they are commonly driven by matrix driver 21 over four phases.

Figure 19:
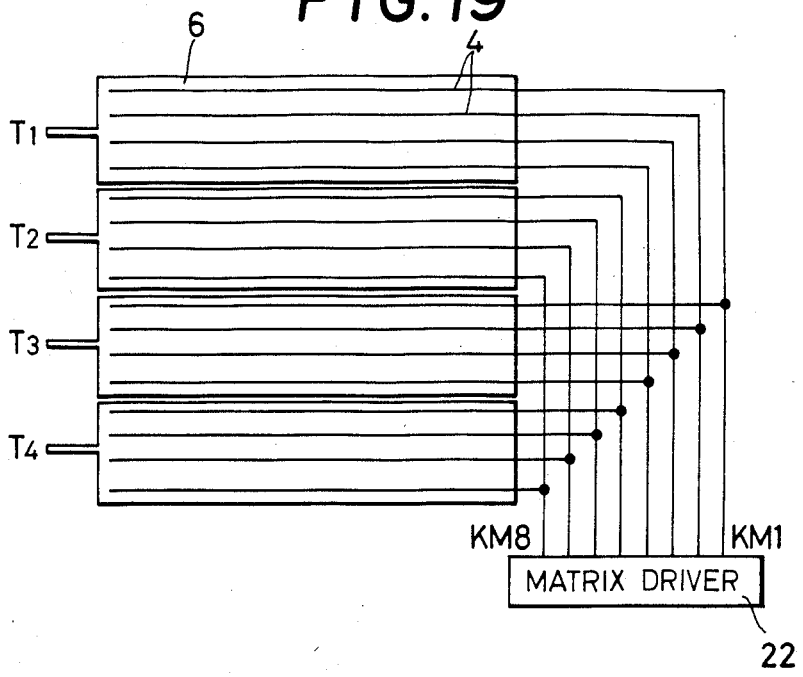
FIG. 19 is a drive circuit diagram illustrating another embodiment of the trigger matrix method.
Figures 20A, 20B, 20C, 20D, 20E, 20F, 20G, 20H:
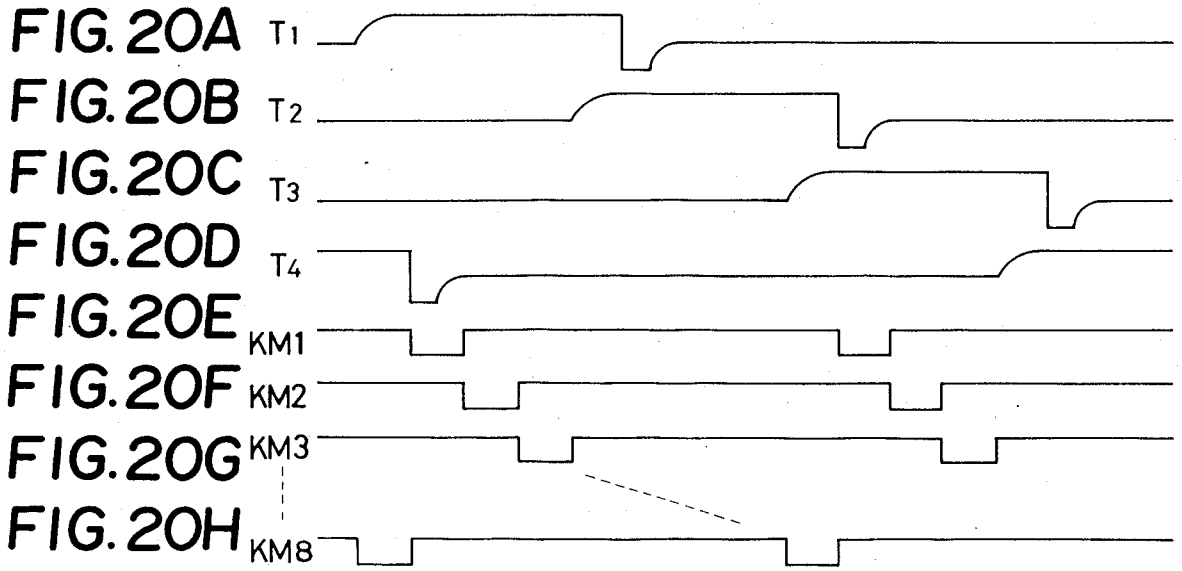
FIGS. 20A through 20H illustrate operational waveform charts for the circuit of FIG. 19.

FIG. 19 shows another drive circuit. This circuit also comprises a four phase trigger in which each phase has four cathodes. As described previously, the overlapping selection of the cathodes associated with the leading and recovery discharges occur between each two adjacent trigger phases. For this reason, in this embodiment, the cathodes in every other trigger phase are commonly driven. As shown in FIG. 19 a first line of a first phase and that of a third phase are commonly driven and a first line of a second phase and that of a fourth phase are commonly driven.

The four phase trigger electrodes are selected and are triggered in a phase sequential manner as indicated by the waveforms T1 through T4 of FIGS. 20A through 20D. The corresponding cathodes in every other phase are sequentially and commonly driven by a matrix driver 22 by the waveforms KM1 through KM8 illustrated in FIGS. 20E through 20H of FIG. 20.

It is to be noted that in the above embodiments the anodes 3 and the cathodes 4 are respectively corresponding to the data and scanning electrodes. However, the display data can be supplied to the cathodes and the anodes can be scanned in a line sequential manner. In this case, the trigger electrodes are arranged along the anodes 3 and a group of a plurality of anodes is covered by one phase of the trigger electrodes.

Furthermore, in the above embodiments, the trigger electrodes are divided in two or four phases so as to perform time divisional drive. However, a single phase drive can be performed without time division. However, in this case in order to hold intervals for the leading and recovery discharges at the start and end of each trigger interval a blanking period may be provided for each frame.

It is seen that this invention provides a new and novel method of applying voltages to various electrodes including the trigger electrodes in a display panel.

Although the invention has been described with respect to preferred embodiments, it is not to be so limited as changes and modifications can be made which are within the full intended scope of the invention as defined by the appended claims.

We claim as our invention:

1. A plasma display panel, comprising pairs of discharge electrodes arranged in an X-Y matrix form with discharge gaps therebetween, and at least one trigger electrode for inducing discharges arranged adjacent one of said discharge electrodes and said trigger electrode separated by an insulating layer from said discharge electrodes, and said discharge electrodes activated in a line sequential manner, a constant trigger voltage supplied to said trigger electrode to generate the inducing discharge between said trigger electrode and said discharge electrodes associated therewith until activation throughout the plurality of said discharge electrodes is completed, and after the induce-discharging, the trigger voltage is abruptly changed from a first voltage to a second voltage which is lower than a third voltage and thereafter is returned to said third voltage whereby said third voltage is between said first and second voltages.

2. A plasma display panel comprising pairs of discharge electrodes arranged in an X-Y matrix form in an envelope with discharge gaps therebetween, at least one trigger electrode for inducing discharges mounted adjacent some of said discharge electrodes and separated therefrom by an insulating layer, a trigger circuit connected to said trigger electrode and producing at least one voltage waveform which varies as a function of time and which has a first voltage level during a first time period which is sufficient to induce discharge and which abruptly changes to a substantially different second voltage for a short second time after said first time and said second voltage is insufficient to initiate induce discharge and said voltage waveform changing during a third time period to a third voltage which is intermediate between the level of said first and second voltages.

3. A plasma display panel according to claim 2 wherein said trigger circuit which produces said at least one voltage comprises a pair of voltage reference sources, first and second switches connected in series between said pair of voltage reference sources, a capacitor, a third switch, said second switch, said capacitor and said third switch connected in series between said pair of voltage sources, a fourth switch connected in parallel with the combination of said second switch and said capacitor, and switch actuating means connected to said first, second, third and fourth switches to open and close them so as to produce said at least one trigger voltage.

4. A plasma display panel according to claim 3 wherein said first, second, third and fourth switches comprise first, second, third, and fourth transistors.

5. A plasma display panel according to claim 4 including a fifth transistor connected to said second transistor to control it, and a sixth transistor connected to said fourth transistor to control it.

6. A plasma display panel according to claim 5 wherein a first resistor is connected between the base of said second transistor and one of said pair of voltage sources and the base of said second transistor connected to the collector of said fifth transistor.

7. A plasma display panel according to claim 4 wherein a second resistor is connected between the emitter of said fifth transistor and one of said pair of voltage sources.

8. A plasma display panel according to claim 4 including a third resistor connected to the base of said first transistor.

9. A plasma display panel according to claim 4 including a fourth resistor connected between said one of said pair of voltage sources and the emitter of said second transistor.

10. A plasma display panel according to claim 4 including a fifth resistor connected between the emitter of said third transistor and one of said pair of voltage sources.

11. A plasma display panel according to claim 4 including a sixth resistor connected between the base of said fourth transistor and said one of said pair of voltage sources.

12. A plasma display panel according to claim 4 including a seventh resistor connected between the emitter of said fourth transistor and said one of said pair of voltage sources.

* * * * *